United States Patent [19]

Korn et al.

[11] 3,937,522

[45] Feb. 10, 1976

[54] APPARATUS FOR CONTINUOUS FEEDING OF GRANULAR MATERIAL WITH SHARP CORNERS TO A CONVEYER PIPE LINE

[75] Inventors: Roland Korn, Nuremberg; Günter Seyd; Uwe Paulsen, both of Erlangen, all of Germany

[73] Assignee: Siemens Aktiengesellschaft, Munich, Germany

[22] Filed: Nov. 16, 1973

[21] Appl. No.: 416,344

[30] Foreign Application Priority Data

Nov. 20, 1972 Germany ..... 2256877

[52] U.S. Cl. ..... 302/56; 259/46; 302/53

[51] Int. Cl.[2] ..... B65G 53/40

[58] Field of Search ..... 302/56, 42, 53, 52, 50; 222/194, 367, 368, 410, 240, 241, 242; 259/45, 46, 4, 6

[56] References Cited

UNITED STATES PATENTS

| | | | |
|---|---|---|---|
| 1,107,015 | 8/1914 | Babcock et al. | 302/56 |
| 1,310,815 | 7/1919 | Weaver | 302/42 |
| 1,450,326 | 4/1923 | Maitland | 302/56 |
| 1,559,666 | 11/1925 | Bernier | 302/56 |
| 1,797,183 | 3/1931 | Wetmore et al. | 302/56 |
| 2,512,175 | 6/1950 | Sawyer | 302/42 |
| 3,411,832 | 11/1968 | Garreau et al. | 302/53 |
| 3,602,394 | 8/1971 | McCune | 302/56 |

*Primary Examiner*—Evon C. Blunk
*Assistant Examiner*—Jeffrey V. Nase
*Attorney, Agent, or Firm*—Kenyon & Kenyon Reilly Carr & Chapin

[57] ABSTRACT

Apparatus for continuous feeding of granular material with sharp corners to a conveyor pipe line through which a compressed-gas carrier flows, includes a vertical cylindrical chamber with a bottom having a central discharge opening connecting with the pipe line and a top having a charging inlet for the material, means in the chamber at different levels acting to alternately lift and release successive portions of the material preventing the grains from interlocking and forming clumps due to their sharp corners. Also, means are provided for feeding the material to the discharge opening into the pipe line and stirring it while feeding through this opening. Other features are included.

2 Claims, 1 Drawing Figure

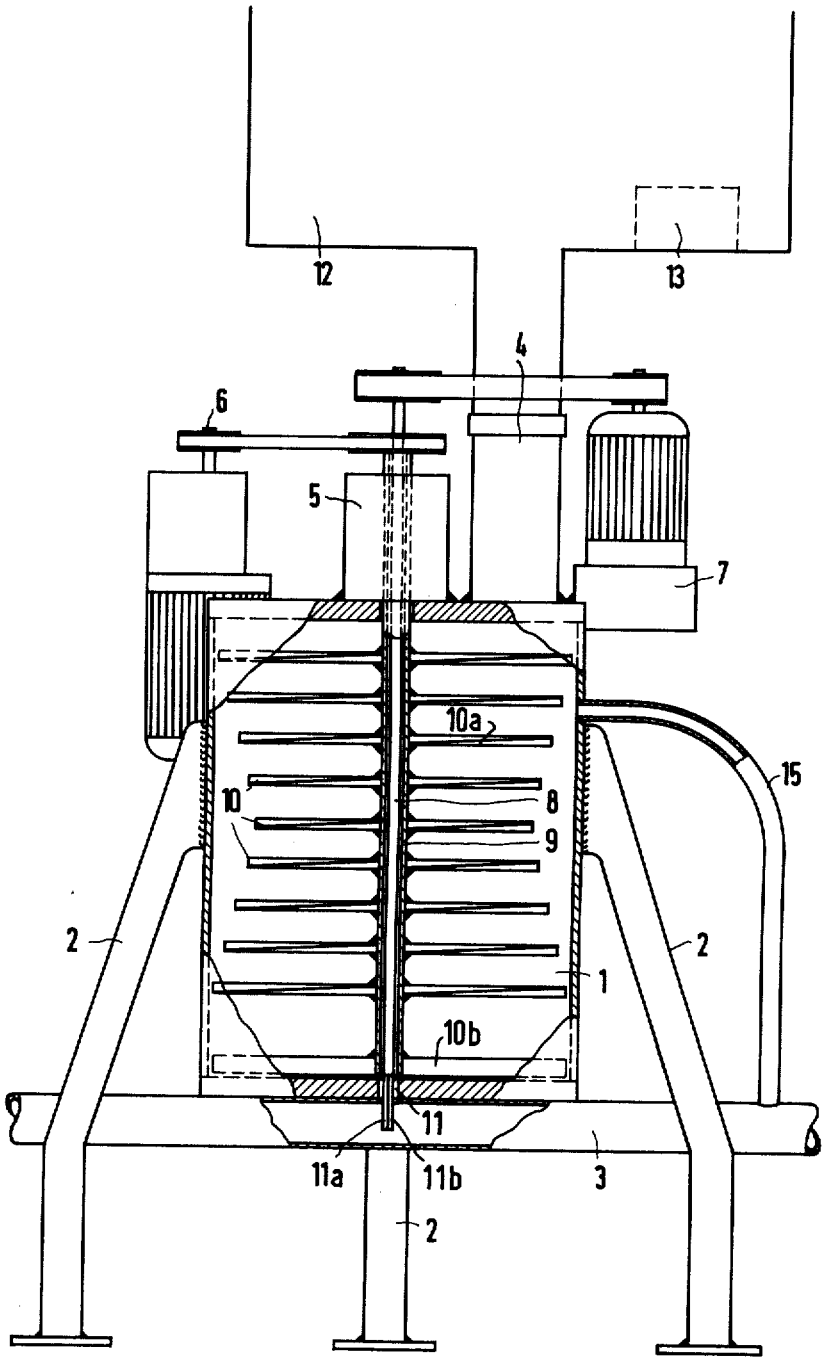
12
13
4
6
5
7
10a
15
10
8
9
2
2
1
10b
11
11a
11b
3
2

APPARATUS FOR CONTINUOUS FEEDING OF GRANULAR MATERIAL WITH SHARP CORNERS TO A CONVEYER PIPE LINE

BACKGROUND OF THE INVENTION

To convey granular material with sharp corners through a pipe line via a compressed-gas carrier, requires the material to be fed to the gas stream as discrete granules through a relatively small opening, for metering, which can be blocked if the fed material becomes entangled or lumpy. Such trouble is inherent in the case of granular material having sharp corners, the sharp corners causing the granules to interlock. Such blockage prevents continuous uniform feeding of the material into the gas stream carrier flowing through the conveyor pipe line.

Such granules particularly tend to form lumps when compressed together as they must be to force them into the conveyor pipe line, as by providing a supply of the granular material above the pipe line for gravity feeding.

A supply of such granular material with the granules flowing freely, carried by the compressed-gas carrier, is desirable for various purposes, such as use in connection with sand-blasting techniques. For example, contaminated surfaces of nuclear reactor components may be cleaned by this technique, using sharp cornered granules of $B_2O_3$, the lumping problem described above being in this instance complicated by the fact that such granules are hydroscopic, increasing the tendency for the granules to clump together and form lumps which cannot be continuously fed into a compressed-gas carrier flowing through a conveyor pipe line. However, other materials also cause trouble, examples being sharp cornered granules of boron carbide, carborundum, quartz and metallic particles such as chips resulting from machining operations.

The object of the present invention is to provide an apparatus for satisfactorily feeding such granular material into a gas-carrier stream flowing through a conveyor pipe line.

SUMMARY OF THE INVENTION

According to the present invention the above object is attained by an apparatus comprising a vertical cylindrical chamber with a bottom having a central discharge opening connecting with the pipe line and a top having a charging inlet for the material. This chamber when charged with the material provides a supply for continuous feeding, this material being, of course, granular material having sharp corners and inherently tending to clump or form lumps capable of blocking the discharge opening which must be relatively small as required to provide a properly metered flow of material into the gas stream.

A number of blades positioned at different levels inside of the chamber rotate in horizontal planes about an axis concentric with respect to the chamber. At the different levels these blades may have different lengths but at least some of them should extend close to the inside wall of the chamber. These blades have upper surfaces which are inclined with respect to their rotative direction so that they provide a means in the chamber at the different levels therein, for alternately lifting and releasing successive portions of the material in the chamber. Both vertical and rotative outward agitation is involved, this positively preventing the granules from interlocking together or otherwise forming clumps or lumps which cannot flow gravitationally through the bottom discharge opening into the pipe line.

Furthermore, the discharge opening itself is provided with a vertical spindle which extends through the opening and into the pipe line, this spindle having vertically extending ribs and when rotated, continuously stirring the flow of discrete granules through the discharge opening, preventing any tendency to form small lumps or clumps while the material flows through the discharge opening.

To assure a proper feed of the material to the discharge opening, rotative blades, also rotating in horizontal planes about an axis concentric to the chamber wall, are positioned close to the chamber's bottom, these blades being formed as a single level, such as by comprising blades radiating in the same level, and their leading sides are shaped to force the granules towards the discharge opening.

The pressure in the chamber is equalized with that of the compressed-gas carrier in the conveyor pipe line by a branch pipe connecting with the conveyor pipe line upstream from the discharge opening through which the carrier material flows, and also connecting with the upper portion of the chamber. The charging inlet of the chamber may be fashioned as a upstanding tube which when containing the granular material is adequate to block the escape of the compressed gas through the inlet.

BRIEF DESCRIPTION OF THE DRAWING

The accompanying drawing provides a single view, partly in vertical section and partly in elevation, and illustrates the invention.

DETAILED DESCRIPTION OF THE INVENTION

Having reference to the above drawing, the vertical cylindrical chamber 1 is firmly mounted by support legs 2 above the conveyor pipe line 3 through which the stream of compressed-gas carrier flows from right to left. The top of this chamber has the vertical upstanding charging inlet 4 reaching high enough so that when charged with the material the escape of the carrier gas is prevented. The top of the chamber 1 also mounts a heavy-duty bearing assembly 5 and electric motors 6 and 7 for driving the rotative components within the chamber. For this purpose, a solid shaft 8 is concentrically extended down through the chamber with its top projecting above the chamber's top and belt driven by the motor 7. Also, a tubular shaft 9 encircles the solid shaft 8 with its upper end likewise extending upwardly to the top of the chamber and belt driven by the motor 6. The heavy bearing assembly 5 supports the two shafts in cantilever fashion.

The blades 10 are shown as radiating from and carried by the tubular shaft 9. The lower one of these blades is spaced above the bottom of the chamber 1, the blades forming a series which extends upwardly in the form of sets of diametrically extending blades, the series of blades, starting at the top and bottom ones, having lengths first reaching out to almost but not quite touch the inside of the cylindrical wall of the chamber 1 and progressively decreasing in length until at the vertical center of the series the blade tips are spaced a substantial distance from the inside of this chamber wall.

Relative to the direction the blades are driven by the motor 6, each blade has a sharp leading edge and an upper surface 10*a* which inclines so as to lift up the material in the chamber 1 as the blade passes through this material. Each lifted portion of material falls after being lifted by the blade. Each blade may comprise a vane which is twisted appropriately to provide the lifting effect. Some rotative stirring and outward thrusting of the material is involved but the action most effective is the successively occurring alternate lifting and falling of the portions of the material successively worked on by the rotating blades. Each blade effects an action alternating lifting and releasing successive portions of the material. It is in this way that the material charged in the chamber is kept in a flowable condition in spite of its inherent tendency to clump or bunch and otherwise interlock to prevent it flowing.

The discharge opening 11 which connects with the inside of the top of the pipe line 3 is concentrically located in the bottom chamber 1. The bottom end of the tubular shaft 9, also concentric with the chamber, terminates shortly above the bottom of the chamber to leave a space through which the material may pass to feed through the discharge opening 11, and this bottom end is provided with blades 10*b* which have no material upwardly lifting effect, but, instead, have leading faces shaped so that with rotating they feed the material forcibly to the upper end of the opening 11.

To prevent clumping or bunching and to safely maintain a free flow of the material through the opening 11, the lower end of the shaft 8 mounts the vertical spindle 11*a* which extends through this opening 11 and downwardly for a substantial distance within the pipe line 3. This spindle 11*a* is provided with vertical ribs 11*b* throughout its length which engage and continuously stir the material flow through the opening 11 and into the pipe line 3.

In the above fashion the free flowing granular material comprising the sharp cornered granules, is not only kept free from bunching or clumping within the chamber 1 to provide a free flowing supply for continuous feeding, but the granules are also kept in this condition while flowing through the opening 11 and being dispersed within the compressed-gas carrier flowing through the pipe line 3.

A supply bin 12 for the material is shown above the apparatus of the present invention and in which a supply of the material may be maintained. The drawing shows the parts of the present invention substantially accurately to scale relative to each other but the bin 12 may be of larger dimensions than indicated rather schematically by the drawing. When feeding hydroscopic material such as the $B_2O_3$ granules, this bin may be supplied with a device 13 for drying or keeping dry the material in the bin, such as by absorbing any water from the material. There are many well-known devices suitable for this purpose. For example, the device may be of the prior art molecular sieve type which absorbs the moisture and which when saturated with the moisture can regenerate by heating, normally effected electrically under the control of temperature and timing devices automating the servicing required.

The motors 6 and 7 may be of the type incorporating reduction gearing. The apparatus shown with the parts accurately scaled relative to each other in the drawing, has been actually reduced to practice. In this instance the chamber 1 was 700 mm high, the material handled being the $B_2O_3$ sharp cornered granules fed to the gas stream carrier and carried along thereby in the conveyor pipe line 3 for possible use for working off contaminated surfaces of nuclear reactor components by sand blasting techniques.

The blades 10 and 10*b* were driven by the motor 6 to obtain blade rotating speeds in the order of 65 rpm, while the spindle 11*a* was driven by the motor 7 to obtain rotative speeds varying from 8 to 160 rpm. The granules were continuously fed into the compressed gas carrier stream as discrete particles which were carried along as such by the carrier gas stream.

To prevent the gas pressure in the conveyor pipe line 3 from resisting the downward flow of the material through the discharge opening 11, on the upstream side of this opening a branch pipe line 15 interconnects the conveyor pipe line 3 and the upper portion of the chamber 1, thus equalizing the gas pressures within the chamber 1 and in the pipe line 3. This means that the chamber 1 operates under the carrier gas pressure and must be designed accordingly as required to resist this pressure. The charging inlet 4 may be made high enough to provide a column of charging material of enough weight to overcome the internal pressure within the chamber 1. If this is not done, the supply bin 12 must perform this function or be provided itself with compressed gas.

Throughout the foregoing, the carrier material has been described as compressed gas. Normally this would be compressed air flowing through the conveyor pipe line 3 at high enough velocity to carry along the discrete granules fed by the apparatus into the pipe line 3.

What is claimed is:

1. Apparatus for continuously feeding granular material having sharp corners to a conveyor pipe line through which a compressed gas stream carrier flows, said apparatus comprising a vertical cylindrical chamber with a bottom having a central discharge opening connecting with said pipe line and a top having a charging inlet for said material, and means in said chamber for at different levels therein alternately lifting and releasing successive portions of said material therein, the first-named means comprising rotative blades positioned at said different levels and having upper surfaces which are inclined with respect to the rotative direction of said blades, the apparatus including a bottom blade in the bottom of said chamber and which is rotative concentrically with respect to said discharge opening and having side surfaces shaped with respect to this bottom blade's rotative direction to feed said material to said discharge opening, said apparatus having means for stirring said material while it feeds through said discharge opening into said pipe line, said stirring means comprising a rotative vertical spindle having vertical ribs and extending through said discharge opening and into said pipe line, said spindle connecting with a vertical drive shaft extending upwardly and concentrically through said chamber and its top, and said blades being mounted by a tubular shaft encircling said drive shaft and also extending upwardly through said chamber and its top, said shafts extending above said chamber's top, for rotative driving thereof.

2. The apparatus of claim 1 including means for interconnecting said conveyor pipe line and the upper portion of said chamber to equalize the gas pressure in said line and chamber, said charging inlet being tubular and extending upwardly so that when filled with said material the escape of said gas therethrough is at least to some extent blocked by said material.

* * * * *